US010376852B2

(12) United States Patent
Hobbs et al.

(10) Patent No.: US 10,376,852 B2
(45) Date of Patent: Aug. 13, 2019

(54) HEATING, MIXING AND HYDRATING APPARATUS AND PROCESS

(71) Applicant: Hydramach Limited, St Neots, Cambridgeshire (GB)

(72) Inventors: Richard Hefford Hobbs, St Neots (GB); Martin Prescott, St Neots (GB)

(73) Assignee: Hydramach Limited, St. Neots, Cambridgeshire (GB)

( * ) Notice: Subject to any disclaimer, the term of this patent is extended or adjusted under 35 U.S.C. 154(b) by 132 days.

(21) Appl. No.: 15/307,628

(22) PCT Filed: Apr. 28, 2015

(86) PCT No.: PCT/GB2015/051239
§ 371 (c)(1),
(2) Date: Oct. 28, 2016

(87) PCT Pub. No.: WO2015/166233
PCT Pub. Date: Nov. 5, 2015

(65) Prior Publication Data

US 2017/0056844 A1 Mar. 2, 2017

(30) Foreign Application Priority Data

Apr. 28, 2014 (GB) ..... 1407428.0

(51) Int. Cl.
*B01F 5/06* (2006.01)
*B01F 5/04* (2006.01)
(Continued)

(52) U.S. Cl.
CPC ..... *B01F 5/061* (2013.01); *B01F 3/0407* (2013.01); *B01F 3/04063* (2013.01);
(Continued)

(58) Field of Classification Search
CPC ..... B01F 5/0473; B01F 5/049; B01F 5/0491; B01F 5/0611; B01F 5/0612;
(Continued)

(56) References Cited

U.S. PATENT DOCUMENTS 5,037,616 A * 8/1991 Williatte ..... B01F 5/0413 422/140
5,435,851 A 7/1995 Kasica et al.
(Continued)

FOREIGN PATENT DOCUMENTS

DE 2241113 2/1974
EP 0399041 11/1990
(Continued)

OTHER PUBLICATIONS

Jeng, Yeau-Ren et al., "Droplets Ejection Apparatus and Methods", Recent Patents on Engineering, vol. 2, No. 3, pp. 201-207, XP055203905, Nov. 1, 2008.

*Primary Examiner* — Marc C Howell
(74) *Attorney, Agent, or Firm* — Diederiks & Whitelaw, PLC.

(57) ABSTRACT

The invention relates to apparatus and a process for mixing a gas/vapour with a process liquid comprising a material and a carrier liquid. The apparatus comprises a passage (10) of polygonal cross section having an inlet (14), an outlet (16) for a process liquid comprising the material, and a nozzle (24) for introducing supersonic gas/vapour at a mixing zone (42) in a single plane.

17 Claims, 7 Drawing Sheets

(51) Int. Cl.

| | |
|---|---|
| ***B05B 1/04*** | (2006.01) |
| ***B05B 1/30*** | (2006.01) |
| ***B01F 15/00*** | (2006.01) |
| ***B01F 3/04*** | (2006.01) |
| ***F28C 3/06*** | (2006.01) |
| ***B01F 11/02*** | (2006.01) |
| ***B01F 15/02*** | (2006.01) |
| ***B01F 15/06*** | (2006.01) |
| ***B05B 15/652*** | (2018.01) |

(52) U.S. Cl.
CPC ..... *B01F 3/04503* (2013.01); *B01F 5/049* (2013.01); *B01F 5/0473* (2013.01); *B01F 5/0491* (2013.01); *B01F 5/0611* (2013.01); *B01F 5/0612* (2013.01); *B01F 11/02* (2013.01); *B01F 15/00162* (2013.01); *B01F 15/00175* (2013.01); *B01F 15/00337* (2013.01); *B01F 15/00344* (2013.01); *B01F 15/0254* (2013.01); *B01F 15/06* (2013.01); *B05B 1/044* (2013.01); *B05B 1/3026* (2013.01); *B05B 15/652* (2018.02); *F28C 3/06* (2013.01); *B01F 2003/04936* (2013.01); *B01F 2005/0636* (2013.01); *B01F 2015/062* (2013.01)

(58) Field of Classification Search
CPC ..... B01F 3/04063; B01F 3/0407; B01F 3/04503; B01F 15/00337; B01F 15/0254; B01F 2003/04936; B01F 5/061; B05B 15/652; B05B 1/044
USPC ..... 366/167.1
See application file for complete search history.

(56) References Cited

U.S. PATENT DOCUMENTS

| | | | | |
|---|---|---|---|---|
| 6,082,713 | A | 7/2000 | King | |
| 2002/0121350 | A1 | 9/2002 | Lamminen et al. | |
| 2004/0013032 | A1* | 1/2004 | Cappellino | B01F 5/0451 366/172.2 |
| 2006/0066005 | A1 | 3/2006 | Tanaka | |
| 2007/0210186 | A1 | 9/2007 | Fenton et al. | |
| 2009/0115096 | A1 | 5/2009 | Ito et al. | |

FOREIGN PATENT DOCUMENTS

| | | | | |
|---|---|---|---|---|
| EP | 0438783 | A2 | 7/1991 | |
| EP | 1514592 | A1 | 3/2005 | |
| GB | 485656 | | 5/1938 | |
| JP | S5531450 | | 3/1980 | |
| JP | S63267424 | A | 11/1988 | |
| KR | 100979674 | | 9/2010 | |
| WO | 2008135775 | A1 | 11/2008 | |
| WO | 2012033461 | A1 | 3/2012 | |
| WO | WO-2012033461 | A1 * | 3/2012 | B01F 5/0471 |
| WO | 2015166231 | A1 | 11/2015 | |
| WO | 2015166232 | A1 | 11/2015 | |

* cited by examiner

Where ... US = Upstream
DS= Downstream
MZ = Mixing Zone
SP = Set Point (individual for that given variable + some deadband)

All control loops may have some combination of P, I or D function applied

HEATING, MIXING AND HYDRATING APPARATUS AND PROCESS

CROSS-REFERENCE TO RELATED APPLICATIONS

This application claims priority to and the benefit of International Application No. PCT/GB2015/051239, filed Apr. 28, 2014, and titled "HEATING, MIXING AND HYDRATING APPARATUS AND PROCESS", which in turn claims priority from United Kingdom Application having serial number 1407428.0, filed on Apr. 28, 2014, both of which are incorporated herein by reference in their entireties.

The present invention relates to apparatus for mixing a material with a gas/vapour. More particularly, the invention relates to apparatus in which steam or other gas/vapour is used for heating and mixing and/or hydrating a material which is provided as a mixture with a carrier liquid, typically in the form of a suspension, an emulsion or a colloidal solution. The invention also relates to a process for the heating, mixing, hydration and/or structural modification of a material using a gas/vapour such as steam.

Many materials can be obtained from natural sources or by synthetic processes in a dry or semi-hydrated form. However, it is often desirable to obtain more fully hydrated forms of these materials. Examples of this can be found in the food industry, where products such as starch, polymeric gums or proteins are often required in a hydrated form so that they have improved organoleptic properties and/or can act as thickening agents, gelling agents, emulsifying agents and stabilisers. However, highly hydrated products are also required in other industries and for other purposes.

Materials including polysaccharides, proteins and other polymers can be mixed with water or an aqueous solution to form a suspension, colloidal solution or emulsion. However, in liquid systems of this type, the material is not fully hydrated and therefore it is often necessary to carry out further processing steps in order to make it suitable for the required purpose.

Even when hydration of the material is not required, it may be advantageous to mix a material with steam. Mixing with steam may, for example, result in the atomisation of a process liquid comprising the material. The production of an atomised or highly dispersed process liquid is advantageous when further processing of the material is intended as the surface area of the process liquid will be greatly increased. In some cases, it may be desirable to mix a material with steam in order to raise the temperature of the material, for example for the purposes of Pasteurisation.

In some cases, a material may be mixed with another gas/vapour, such as air or carbon dioxide, or with a mixture of two or more gases/vapours.

Several processes are known for the mixing, hydrating and heating of products such as starch. For example U.S. Pat. No. 5,435,851 describes a continuous coupled jet-cooking and spray drying process in which an aqueous slurry is firstly jet cooked with steam before being conveyed to a spray-dryer. EP0438783 describes an apparatus for cooking and spray-drying starch. In this apparatus, a slurry containing starch flows through an aperture into a vertical nozzle and steam is fed through a series of apertures into the nozzle, where the apertures through which the steam is introduced are positioned such that the steam intersects the flow of slurry such that it heats and atomises the starch slurry. Processes such as these, which involve spray drying are typically intended to partially hydrate or otherwise modify a material or to make them more suitable for storage or shipping. They do not lead to the production of a highly hydrated product because the spray drying process tends to dehydrate the product, which may subsequently have to be hydrated by the end-user.

WO2008/135775 also describes apparatus for hydrating a starch-based slurry. In this case, the slurry is fed into a supply line and then steam is fed through an annular nozzle into the supply line where it mixes with and hydrates the slurry.

The device of WO2008/135775 has the problem that it is difficult to ensure efficient mixing of the steam and the slurry. Indeed, the device of WO2008/135775 is described as a fluid mover (i.e. a pump) and as such all geometry associated with the device is optimised to achieve that function, with any mixing capability as a by-product. Because of this, the device is designed such that the steam intersects the flow of slurry at an angle of impingement of 30° or less, which makes it inefficient as a mixer and hydrator.

Although WO2008/135775 teaches that the injection of steam into the slurry atomises the process liquid within the slurry to create a dispersed droplet flow regime, our studies have shown that this is not really the case. This is because the angle of impingement of the steam is not sufficient to ensure efficient mixing of the starch slurry with the steam. Our studies of the device of WO2008/135775 have shown that when the steam enters the supply line through the annular nozzle, it tends to flow along the wall of the supply line rather than penetrating the slurry. The result of this is that while starch slurry flowing close to the wall of the supply line mixes with the steam, is converted to a vapour phase and may be mixed or hydrated to some extent, the starch slurry in the centre of the supply line is not converted to a vapour phase and so is not fully mixed or hydrated.

The inventors therefore sought to provide an improved device for the heating and mixing and/or hydrating of materials, including products such as starch.

In the present invention there is provided apparatus for mixing a material with a gas/vapour, the apparatus comprising:

i. a passage defined by a wall and having an inlet for a process liquid comprising the material and a carrier liquid and an outlet such that the process liquid flows from the inlet towards the outlet; and
ii. a nozzle for introducing a gas/vapour at supersonic velocity into the passage at a mixing zone, wherein the cross sectional area of the passage at the mixing zone is smaller than the cross sectional area of the passage at the inlet;

characterised in that the cross sectional profile of the passage at the mixing zone is polygonal and the nozzle is configured as a slit, wherein the slit runs in a direction substantially perpendicular to the direction of flow of the process liquid at the inlet such that the steam enters the passage in a single plane.

A particular advantage of the apparatus of the present invention is improved mixing of the process liquid with the gas/vapour. The aim of the apparatus is to use the energy of the gas/vapour to atomise the process liquid. The atomised process liquid will have a large surface area available for contact with the gas/vapour allowing for efficient mixing of the gas/vapour with the atomised process liquid and/or efficient hydration of the material (when the gas/vapour comprises steam). In order to achieve such efficient mixing and/or hydration, it is clearly necessary to maximise the contact of the process liquid with the gas/vapour.

Currently known mixing and hydrating devices such as that described in WO2008/135775 have an annular or substantially annular nozzle which injects steam into the device around the circumference of the stream of the process liquid. The present inventors have conducted flow studies with devices of this type which have demonstrated that when steam is introduced via an annular nozzle, it appears mainly to be deflected from the surface of the process liquid rather than penetrating the stream of process liquid. Thus, efficient mixing and hydration is not achieved with the device of WO2008/135775.

The apparatus of the invention has a passage with a polygonal cross section at the mixing zone and therefore it is possible to configure the nozzle as a slit in one of the flat faces of the wall of passage, and to orientate the slit such that it is substantially perpendicular to the direction of flow of the process liquid. Therefore the gas/vapour enters the passage and intersects the flow of process liquid in a single plane which, the inventors have found, allows it to penetrate the flow of process liquid more effectively.

Furthermore, the inventors have found that for any given values of flow rate of process liquid and pressure and temperature of gas/vapour supplied to the nozzle, stalling of the flow of process liquid at the mixing zone is less likely to occur when the gas/vapour is introduced into the passage in a single plane rather than via an annular nozzle. If stalling does occur, it is much easier to re-start the flow of process liquid in the apparatus of the present invention. The term "stalling" refers to the condition where the back pressure of the process liquid at the mixing zone is sufficient to halt the flow of process liquid from the mixing zone to the outlet.

As a result, it is possible to achieve much more efficient mixing and hydration than with prior art devices. In the past, it has been conventional practice to employ several mixing and hydrating devices in series, which necessitated complex temperature and pressure adjustments at the inlets and outlets of these devices. This is not necessary with the device of the present application where satisfactory mixing can be achieved with a single device.

In the context of the present invention the term "gas/vapour" refers to a gas, a vapour or a mixture of the two. In many cases, the gas/vapour is steam but it is also possible to use other gases or vapours, for example air or carbon dioxide, or mixtures of two or more gases/vapours. More suitably, the gas/vapour is steam or a mixture comprising steam. Most suitably the gas/vapour is steam.

The temperature of the gas/vapour may be higher than that of the process liquid.

Suitably, when the gas/vapour is steam the temperature of the steam when it is introduced into the mixing zone will be at least 100° C. and often it will be greater than this, for example 100-200° C. Other gases/vapours may also be introduced at raised temperatures, for example at greater than 80° C., more usually greater than 100° C. However, as discussed below, the temperature of the gas/vapour will follow Boyle's law and so will vary according to the pressure at which it is supplied.

The mixing and heating and/or hydrating process may be such that it transforms the material into a form which is more suitable for its required use. When the gas/vapour is steam, the mixing and/or hydrating which takes place in the apparatus of the present invention will result in the heating of the process liquid by the steam and can also lead to one or more other effects, including structural modification of the material. Examples of these effects include separation of individual particles, hydrating, homogenising, mixing, agitation, wetting, expanding (pulling apart the structure of the molecule under low pressure) or other modification of the material. In addition, heating with steam may also be used for Pasteurisation of the material.

The apparatus of the present invention enables the manufacture of a high quality product with less expenditure of energy and time than current processes. The reduced time taken for mixing and hydration using the apparatus of the present invention means that a mixed and hydrated product can be made on demand, which not only eliminates the need for storing bulky pre-prepared materials, but reduces the "Work In Progress" (WIP) and manufacturing time. The quality of the product can also be increased as its exposure to microorganisms such as bacteria and fungi is reduced, due in part to the reduction in manufacturing time. This is particularly important when the product is a food product. In addition, while many conventional mixing processes are batch processes, the apparatus of the present invention enables a flow through process to be used, which means that it is simple to vary the amount of product produced so that wastage can be reduced.

In the present specification, except where the context requires otherwise due to express language or necessary implication, the word "comprises", or variations such as "comprises" or "comprising" is used in an inclusive sense i.e. to specify the presence of the stated features but not to preclude the presence or addition of further features in various embodiments of the invention.

In the context of the present invention, the term "material" relates to any material which requires mixing with a gas/vapour in order for it to become more useable. The material may be a polymer, for example a protein, carbohydrate, or hydrocarbon polymer. Alternatively, the material may be a fat.

Suitably, the materials which are heated and mixed and/or hydrated using the apparatus of the present invention are polymers. In one embodiment, the materials are food materials, in particular materials comprising polysaccharides or proteins.

Examples of materials which comprise polysaccharides include starch; natural gums such as agar, alginic acid, sodium alginate, carrageenan, gum Arabic, gum tragacanth, guar gum, locust bean gum, beta-glucan and xanthan gum; cellulose and carboxymethylcellulose.

The apparatus of the invention is also suitable for heating and mixing and/or hydrating proteins as well as other polymeric materials. When the material is a protein, it may be an enzyme.

Other materials which can be mixed using the apparatus of the present invention include waste materials, for example materials to be fed into an anaerobic digester.

The gas/vapour is introduced into the passage via a nozzle. The terms "nozzle" and "steam nozzle" (when the gas/vapour is steam) refer to a profiled gap through which gas/vapour is fed to interact with the process liquid. The nozzle profile is a convergent-divergent section, which, in the art, is typically described as a "de Laval" nozzle, and the profile is designed such that the flow of gas/vapour on exit from the nozzle can achieve supersonic velocity.

The "mixing zone" is the region of the passage at which gas/vapour enters and includes the whole of the region in which mixing of the gas/vapour with process liquid takes place.

The term "cross sectional profile" refers to the shape and/or the area of a cross section of the passage at any given point, particularly within the mixing zone.

In the present invention, the term "process liquid" refers to a composition of a material in a carrier liquid. The process liquid may be a suspension of a solid in a liquid, a colloidal solution or suspension or an emulsion, including an oil-in-water or water-in-oil emulsion or a double emulsion which may be a water-in-oil-in-water or an oil-in-water-in-oil emulsion. The precise nature of the process liquid will depend upon the nature of the material to be hydrated. In some cases, the process liquid may be atomised and may enter the inlet of the passage as droplets. However, more usually, it will be in conventional liquid form.

In the present specification, references to the angle between the direction of the flow of gas/vapour and the direction of flow of the process liquid are intended to refer to the angle formed by the plane of the gas/vapour entering the passage and a second plane running parallel to the direction of flow of process liquid at the point of intersection of the gas/vapour and the process liquid and.

In the apparatus of the present invention, the wall of the passage may be constructed from a metallic material, for example stainless steel, or from other materials such as ceramic, composite materials, plastics or combinations of these. The wall of the passage may also include surface hardening or coatings.

As explained above, the nozzle is configured as a slit which runs in a direction substantially perpendicular to the direction of flow of the process liquid at the inlet. The slit may be set into the wall of the passage. Since the passage is polygonal in cross section at the mixing zone, the wall at the mixing zone will be made up of straight sided sections and this is advantageous because a nozzle configured as a slit in one of these straight sides will supply steam into the passage in a single plane. Suitably, the nozzle extends across the whole of one of the straight sided sections of the wall at the mixing zone.

At the mixing zone, the passage may be a 4 to 8 sided polygon in cross section but typically, the cross section of the passage at the mixing zone is square or rectangular. A passage of polygonal cross section has the further advantage that the passage wall, or a part of the wall may be constructed from a material which is not easily formed into curved sections.

The passage upstream and downstream of the mixing zone may also have a polygonal cross sectional profile and in this case it will suitably have the same shape in cross section as the passage at the mixing zone, although as explained above, the cross sectional area of the passage at the mixing zone is smaller than the cross sectional area of the passage at the inlet. Often, the cross sectional area of the mixing zone is reduced compared with the cross sectional area of the passage at any point upstream of the mixing zone.

As mentioned above, the nozzle suitably extends across the whole of one of the straight sided sections of the wall at the mixing zone and this is particularly advantageous when passage at the mixing zone is square or rectangular in cross section because it is simple to ensure that the flow of gas/vapour intersects the whole of the flow of process liquid.

Therefore, particularly suitable devices of the present invention have a passage which is square or rectangular in cross section at the mixing zone and a slit nozzle which extends across the entirety of one side of the passage.

Suitably, the nozzle is positioned in the wall of the passage above process liquid such that the gas/vapour flows downwards towards the process liquid.

The nozzle may also be configured such that the angle of impingement of the gas/vapour on the process liquid (i.e. the angle between the direction of the flow of gas/vapour and the direction of flow of the process liquid) is at least about 10°, suitably at least about 20°, more suitably at least 25° or at least 30°. For example the angle between the direction of the flow of gas/vapour and the direction of flow of the process liquid may be between about 20° and 90°.

The optimum angle of impingement for efficient mixing of the gas/vapour with the process liquid will vary according to the cross sectional profile of the passage; the particular properties of the process liquid, for example its flow rate, viscosity and temperature; and also the nature of the gas/vapour and its pressure and temperature. However, it has been found that for many process liquids, improved mixing is obtained when the angle between the direction of the flow of gas/vapour and the direction of flow of the process liquid is between about 25° and 90°, more suitably between about 30° and 90°. This is particularly the case when the gas/vapour is steam.

In prior art devices where the gas/vapour was steam, such as that of WO2008/135775, the angle of impingement of the steam on the process liquid was about 30° but it appears that the annular flow of steam into the passage prevents efficient mixing of the steam with the process liquid.

In some cases when the gas/vapour is steam, the nature of the process liquid is such that the angle between the direction of the flow of steam and the direction of flow of the process liquid is between about 35° and 80°, for example between about 35° and 60°, typically between 40° and 50°.

In some circumstances it may be advantageous to change the shape of the nozzle in order to optimise the processing of different materials. For a de Laval nozzle, the nozzle profile can be varied in order to change the velocity and flow characteristics of the gas/vapour. Therefore, the nozzle may be removable and the apparatus may be provided with a set of removable nozzles of different profiles.

In an alternative embodiment, the nozzle is formed from a plurality of segments which can be removed and replaced with segments of alternative profile in order to vary the profile of the nozzle.

In yet a further embodiment, the nozzle may be a dynamically changeable nozzle in which the profile may be varied using a suitable control system. Such dynamically changeable nozzles are known in the art.

The nozzle may be provided in a rotatable member mounted in the wall of the passage; wherein the rotatable member is rotatable through an arc of at least 10° such that the angle between the direction of the flow of gas/vapour and the direction of flow of the process liquid can be varied.

If it is necessary to change the nozzle profile in this type of device, the nozzle may be removable or have a variable profile as discussed above and the device may be provided with a set of removable nozzles or nozzle segments or may include a control system for varying the nozzle profile. Alternatively, the nozzle may be fixed in the rotatable member; the rotatable member may be removable and the device may be provided with a set of removable rotatable members having nozzles with different profiles.

In the present invention, the term "rotatable member" is intended to refer to a member which can rotate through an arc or at least 10° about an axis of rotation which is substantially perpendicular to the direction of flow of the process liquid at the inlet. Rotation of the rotatable member through a larger arc may not be necessary, although in some embodiments 360° rotation may be employed. In other embodiments, however, the rotation may be about 180° or less. The rotatable member can be any shape, provided that rotation of the nozzle through the required arc is possible. For example, it may take the form of a cylinder which rotates about its longitudinal axis. Alternatively, however, the rotatable member may be in the form of a section of a cylinder which is hinged such that it rotates around its straight edge. In yet a further embodiment, the rotatable member may be spherical or may be in the shape of a segment of a sphere.

The rotatable member may be fixable at any point of its rotation. Therefore, for any given process liquid, once the optimal angle between the direction of the flow of steam and the direction of flow of the process liquid has been determined, the rotatable member may be fixed in position.

The rotatable member may rotate through an arc of at least 10° such that the angle between the direction of the flow of steam and the direction of flow of the process liquid can be varied.

The arc of rotation may be greater than 10°. For example, more suitably, the rotatable member may rotate through at least 20°, at least 30°, at least 40°, at least 50°, at least 60°, at least 70°, at least 80° and up to about 90°. The rotatable member may also rotate through an arc of more than 90°, for example up to 180° or even, in some cases, up to 360°.

As discussed above, the angle between the direction of the flow of gas/vapour and the direction of flow of the process liquid may be at least about 20°. This is particularly the case when the gas/vapour is steam. Therefore in devices in which a rotatable member is provided, the minimum angle between the direction of the flow of steam and the direction of flow of the process liquid is suitably at least 20° and still more suitably at least 25° or at least 30°.

In the cases where the minimum angle is 20°, 25° or 30° and the rotatable member rotates through 10°, the angle between the direction of the flow of steam and the direction of flow of the process liquid would vary from 20° to 30°, 25° to 35° and 30° to 40° respectively.

When the gas/vapour is steam, the minimum angle between the direction of the flow of steam and the direction of flow of the process liquid is usually about 40°. Where this is so and where the rotatable member rotates through 10°, the angle between the direction of the flow of steam and the direction of flow of the process liquid would vary from 40° to 50°.

In the above examples, an arc of rotation of 10° is mentioned as this is the minimum amount of rotation required. However as explained above, in many cases, the rotatable member may move through a greater arc of rotation. Thus for example, if the rotatable member moves through an arc of 50°, the angle between the direction of the flow of steam and the direction of flow of the process liquid could vary from 20° to 70° or 30° to 80° or 40° to 90°; and if the rotatable member moves through an arc of 60°, the angle between the direction of the flow of steam and the direction of flow of the process liquid could vary from 20° to 80° or 30° to 90°.

The wall of the passage may form a housing for the rotatable member such that the surface of the rotatable member is exposed only over an arc through which rotation is required for the addition of gas/vapour to the process liquid.

In one embodiment, the rotatable member is configured such that it can be rotated into a position in which the nozzle abuts the wall of the passage such that the outlet of the nozzle is effectively closed off from the passage, preventing or substantially limiting the flow of gas/vapour.

This embodiment has the further advantage that when gas/vapour is not being added, the nozzle can be closed or substantially closed, preventing the entry of the process liquid into the nozzle and from there into the gas/vapour feed pipework nozzle. Entry of the process liquid into the nozzle and the gas/vapour feed pipework nozzle can lead to precipitation, compaction or hardening of the material and therefore blocking of the nozzle or feed pipework nozzle.

In some cases, particularly when the gas/vapour is steam, the rotatable member may rotate through a full 360° such that the nozzle can be directed into the gap between the rotatable member and the portion of the wall of the passage which forms the housing for the rotatable member. In this configuration, steam can be directed into the gap between the rotatable member and the housing in order to clean the gap, clear debris and prevent sticking of the rotatable member.

In one embodiment, the rotatable member may be cylindrical or substantially cylindrical. In this case, it may be rotatable about its longitudinal axis and the slit nozzle may run parallel to the longitudinal axis of the cylinder.

In another embodiment, the rotatable member may be in the shape of a segment of a cylinder which rotates about its straight edge and the nozzle may run parallel to an edge of the segment which corresponds to the longitudinal axis of the cylinder.

In some cases, the rotatable member and the wall of the passage may be constructed from different materials, which may be selected from the materials listed above. It may, for example, be advantageous for the rotatable member to be constructed from a material which has a lower coefficient of thermal expansion than the material from which the wall of the passage is constructed. This will ensure that any heating of the apparatus by the steam does not cause the rotatable member to expand more than the wall of the passage, which could lead to inhibition of the rotation of the rotatable member.

It may also be advantageous for the materials from which the apparatus is constructed to be chosen such that there is a low coefficient of friction between the rotatable member and the wall of the passage in which the rotatable member is mounted. One way in which a low coefficient of friction can be achieved is by the provision of a low friction coating on either or both of the surface of the rotatable member and the surface of the wall in the area in which the rotatable member is mounted.

In some cases, the rotatable member, the nozzle and/or the walls of the device may have a coating or be surface treated. Suitable coatings include non-stick materials such as PTFE or a silicone or ceramic coatings which prevent debris from sticking to the surfaces and blocking the nozzle or preventing rotation of the rotatable member. Alternatively, or in addition, a wear or abrasion resistant coating, such as a titanium aluminium nitride coating, may be used for some parts of the device or the surfaces of parts of the device may be surface treated to increase their hardness or abrasion resistance for example by anodising. This is particularly useful if the process liquid has abrasive properties.

In the present invention, the mixing zone may have a variable cross sectional profile. In order for satisfactory mixing to take place, the cross sectional area of the mixing zone is reduced compared with the cross sectional area of the inlet. Often, the cross sectional area of the mixing zone is reduced compared with the cross sectional area of the passage at any point upstream of the mixing zone. The reduction of the cross sectional area may be variable so that the profile of the mixing zone can be altered depending on the nature of the liquid to be processed.

In order to vary the cross sectional profile of the mixing zone, there may be provided one or more movable flaps mounted on the inner wall of the passage at the mixing zone. Each flap may be hinged at one end, suitably at the upstream end, and may be rotatable through an arc of up to about 60°, more usually 5 to 50°, for example 10 to 30°, between a first position and a second position in which it forms a lesser angle with the wall of the passage.

The flap may have a flat upper face and in this case, in the first position, the flap may lie flush (i.e. may form an angle of 180°) with the wall of the passage. However, more usually, it will form an angle somewhat smaller than 180° with the wall of the passage so that the upper face of the flap protrudes into the passage such that the cross sectional area of the mixing zone is reduced compared with the cross sectional area of the passage upstream of the mixing zone. The smaller angle formed by the flap in the first position may be, for example, 175° to 165°.

In the second position, the flap forms a lesser angle with the wall of the passage. The minimum angle formed between the flap and the passage wall when the flap is in the second position may be between 160° and 120° but will usually be about 150°.

Thus, a flap of this type may be rotatable through an angle of about 10 to 50°, for example 10 to 30°.

Alternatively, the flap may have a contoured upper face, for example an upper face with a curved or angled profile, particularly a convex profile such that the flap forms a greater angle with the passage wall at its upstream end than at its downstream end. For a flap of this type, the angle through which it rotates may be smaller, for example about 5 to 20°, typically 5 to 15°, for example 10 to 12°.

The flap may be fixable into position at the first and second positions and optionally in one or more additional positions between these extremities. In one embodiment, a flap may be fixable at any position between the extremities of its rotation. Therefore, when optimum processing conditions have been determined for a particular process liquid, the flap may be fixable at the optimum position when the apparatus is used to hydrate that process liquid.

Alternatively or in addition to the flaps, a reduction in cross section of the mixing zone may be achieved by one or more projections from the wall of the passage at the mixing zone.

These one or more projections may protrude into the passage at the mixing zone in order to vary its cross sectional are and/or profile. In one embodiment, the one or more projections are configured such that the cross sectional area of the mixing zone is reduced compared to the passage upstream of the mixing zone but the cross sectional shape of the mixing zone remains substantially unchanged.

Alternatively, the one or more projections may reduce the cross sectional area and also alter the cross sectional shape of the mixing zone.

If the cross sectional profile of the mixing zone is variable, the size and/or position of the projections must also be variable. One way of achieving this is to provide projections at the mixing zone which are movable between a first position wherein they are withdrawn into the wall and a second position wherein they protrude into the passage. The projections may be fixable at the first and second positions and/or at one or more positions intermediate the first and the second position.

In an alternative embodiment, the projections are not moveable but may be removed and the apparatus is supplied with a set of such removable projections having different sizes and shapes such that the internal cross sectional shape and/or cross sectional area of the passage can be varied at the mixing zone.

The surfaces of the projections which are in contact with the process liquid may be flat. However, alternatively, they may be shaped or contoured so as to maximise the mixing of the process liquid with the gas/vapour.

In one embodiment, a reduction in cross sectional area is achieved by a flap or projection positioned substantially opposite the nozzle.

In an alternative embodiment, the reduction in cross sectional area is achieved by a flap or projection positioned substantially adjacent and downstream of the nozzle.

In a further embodiment, the reduction in cross sectional area is achieved by a plurality of flaps or projections which protrude into the passage at the mixing zone. For example, there may be one flap or projection positioned substantially opposite the nozzle and a second flap or projection positioned substantially adjacent and downstream of the nozzle.

A reduction in the cross sectional area of the passage in the mixing zone may give rise to an area of shearing turbulence such that mixing of the process liquid with the gas/vapour (for example steam) is increased. The use of movable or removable flaps or projections allows the configuration of the region of the passage in which mixing takes place to be varied and optimised.

In addition, where there is a projection from the wall or where a movable flap is employed, this may give rise to an area of eddy turbulence at the downstream end of the projection or the flap. In some cases, this can also improve mixing of the gas/vapour (for example steam) and the process liquid.

In some embodiments, the wall of the passage may be provided with ducts for carrying a heating or cooling fluid. The ducts will not be in fluid communication with the passage and will usually be formed within the wall of the passage.

The ducts may run the whole length of the passage or, alternatively may be provided only over one or more regions of the passage.

In some cases, where the gas/vapour is at high temperature, for example when the gas/vapour is steam, the ducts will carry a cooling fluid, for example cold water. The provision of cooling fluid in the ducts will ensure that the walls of the passage remain cool so as to prevent any hot spots which might otherwise form as a result of excessive heating by the steam. It is sometimes desirable to prevent excessive exposure of the material to heat, particularly for materials such as proteins or polysaccharides which may be denatured by excessive heat.

Where the ducts are intended to carry a cooling fluid, they may be provided along the whole length of the passage or alternatively in the region of the mixing zone or region between the mixing zone and the outlet of the passage.

In other cases, the ducts may carry a heating fluid, for example hot water. The provision of heating fluid in the ducts may be advantageous when the material is such that it is necessary to maintain a high temperature along the length of the passage.

Where the ducts are intended to carry a heating fluid, they may be provided along the whole length of the passage. Alternatively, they may be provided in one or more of: the region between the inlet and the mixing zone; the mixing zone; and the region between the mixing zone and the outlet.

The apparatus may further include means for observing and measuring the mixing and/or hydrating process. Where such means are included, the apparatus may also include a control system which moves the flaps or projections to change the configuration of the mixing zone. When the nozzle is rotatably mounted, the control system may also change the angle of the nozzle.

One way in which the mixing and/or hydrating process can be observed is visually. Therefore, the wall of the passage may further include one or more sections formed from a transparent material in order to provide an inspection window such that an observer can view the mixing and/or hydrating process in order to assist with optimisation of the mixing conditions. The section formed from transparent material may extend around all or part of the circumference of the wall. Borosilicate glass is a particularly suitable material for such transparent sections because of its high resistance to heat and pressure. When an inspection window is provided, with the polygonal cross section of the device is advantageous since many transparent materials such as borosilicate glass are more easily formed into flat panels than into curved panels such as would be needed for a passage of substantially circular cross section.

An alternative method of observing the mixing and/or hydrating process is by the use of an ultrasonic sensor. Therefore the device may be provided with an ultrasonic sensor which protrudes into the passage at or adjacent the mixing zone or downstream of the mixing zone. The ultrasonic sensor may comprise a piezoelectric element and may vibrate at different frequencies depending on the state of the liquid adjacent the sensor. For example, atomised liquid may cause vibration of the sensor at one frequency and conventionally flowing liquid may cause vibration at a different frequency or may not cause vibration. Ultrasonic sensors of this type are well known and are readily available.

In some cases, it may be necessary to add additional agents to the process liquid either before or after mixing and/or hydrating with gas/vapour such as steam. Therefore, the passage may be provided with one or more ports for the addition of such additional agents. The additional agents may be added by injection, optionally under pressure, in which case the ports will be injection ports. Alternatively, the additional agents may be added by injection and/or eduction under low pressure generated within the mixing zone.

The ports may be provided in the wall of the passage. Alternatively, however, when flaps are present, the ports may be provided in a flap such that material may enter the passage through the flap.

The additional agent added may be a further material which requires heating and mixing and/or hydration. Such further materials may be added to the process fluid before it is contacted by the gas/vapour. More suitably, however, such further materials will be added in or adjacent the mixing zone or in the region of the passage between the mixing zone and the outlet.

Alternatively, the additional agent added may be a solvent, particularly a solvent which is intended to form a suspension or an emulsion with the atomised process liquid. Such additional agents will usually be added either in the mixing zone or in the region of the passage between the mixing zone and the outlet.

When the gas/vapour is steam or a mixture including steam, the apparatus may additionally incorporate an ultrasonic droplet generator positioned so as to intersect the flow of the process liquid, gas phase (steam) or boundary between the two. The droplet generator may be positioned upstream, adjacent or downstream of the point at which steam is introduced. Suitably, it will be positioned adjacent or downstream of the steam introduction means such that the sound waves will cause resonation and cavitation of droplets of the vapour formed by the contact of the steam with the process liquid. This further increases the surface area of the droplets, and thus the opportunity for increased mixing and/or hydration of the material.

In one embodiment, the ultrasonic droplet generator may include a means for injecting a further liquid, for example an oil into the process liquid, gas phase or boundary between the two. The further liquid may be injected through the droplet generator such that it forms droplets before mixing with the process liquid or the steam.

Suitably, the carrier liquid in the process liquid is water or an aqueous solution containing one or more solutes. When the material is intended for human or animal consumption, any such solutes will be edible or non-toxic.

The temperature of the process liquid as it enters the apparatus will depend upon the particular material to be mixed. For example for starch it may be about 60-80° C. whereas for many gums, a much lower temperature, for example 35-45° C. is needed in order to avoid denaturing of the gum.

In some embodiments, therefore the apparatus further includes means for heating the process liquid positioned upstream of the means for introducing gas/vapour. More usually, the heating means will be connected upstream of the inlet of the passage. Many types of heating device are known and any conventional heating means is suitable for use with the apparatus of the present invention. In one embodiment, the heating means is a heated water jacket which surrounds a vessel positioned upstream of the inlet. The vessel may also be provided with means for stirring the process liquid in order to ensure even heating of the process liquid. After the initial heating the process liquid will be transferred to the passage via the inlet.

The apparatus may also include temperatures sensors for measuring the temperature upstream and downstream of the mixing zone so that the temperature difference across the apparatus may be calculated.

Since the gas/vapour heats the process liquid, there is a temperature difference across the apparatus.

The apparatus may further include a pump for moving the process fluid from the inlet to the outlet.

The flow rate at which the process liquid is supplied to the inlet will depend upon the size of the apparatus and may vary from about 2 to 1000 L/minute across a range of different scaled devices.

In addition, the apparatus may include a source of gas/vapour (for example steam). When the gas/vapour is steam, it may be supplied to the rotatable member at a pressure of from about 3-10 bar ($3\times10^5$ to $10^6$ Pa), suitably from 5 to 7 bar 5($\times10^5$ to $7\times10^5$).

The pressure of gas/vapour must be adjusted such that the velocity of the gas/vapour reaches the speed of sound at the narrowest part of the nozzle (choked flow), ensuring that it will be accelerated to supersonic speed after the constriction in the nozzle and at the point of impact with the process liquid.

The temperature of the gas/vapour will follow Boyle's law and so will vary according to the pressure at which it is supplied but, for example steam at a pressure of about 6 bar will be at a temperature of about 165° C.

Optimum processing conditions will vary depending upon the particular process liquid and there are a number of parameters which can be varied in order to vary the processing conditions. These include, though are not limited to:

gas/vapour pressure supplied to the nozzle;

temperature difference across the apparatus;

flow rate of process liquid;

where the apparatus comprises a rotatable nozzle, angle between the direction of the flow of gas/vapour and the direction of flow of the process liquid; and angle of any flaps present in the apparatus.

Because the relationship between these parameters is quite complex and because changing one of them can affect the others, it is often advantageous to provide a control system equipped with sensors to monitor and vary the parameters.

Therefore, in a further aspect of the invention there is provided a system for mixing a material with a gas/vapour, the system comprising:

a reservoir for a process liquid comprising the material and a carrier liquid; apparatus according to the first aspect of the invention in fluid connection with the reservoir;

a collection vessel for mixed material in fluid connection with the apparatus according to the first aspect of the invention;

a pump for pumping the process liquid from the reservoir, through the apparatus and into the collection vessel;

a source of gas/vapour in fluid connection with a nozzle of the apparatus of the first aspect of the invention;

a control system for controlling:

i. the pressure and/or temperature of the gas/vapour; and optionally one or more of:

ii. a heating element for raising the temperature of the process liquid upstream of the mixing zone;

iii. a pump for pumping the process liquid through the apparatus;

iv. a rotatable member (if present) in order to vary the angle between the direction of the flow of gas/vapour and the direction of flow of the process liquid; and v. the positions of one or more movable flaps (where present).

Suitably, the gas/vapour is steam, although other gases/vapours may be used as discussed above in relation to the apparatus.

The control system may be provided with sensors for detecting the temperature of the process liquid upstream and downstream of the mixing zone, such that the temperature difference across the device can be measured; wherein a temperature difference which is lower than a selected value is an indication that thorough mixing is not taking place.

When the flow rate of process liquid drops below a selected threshold value or when the system is stopped and ready to start, the control system may:

decrease the gas/vapour pressure; and/or increase the pump speed; and/or cause a rotatable nozzle (if present) to rotate in order to decrease the angle between the direction of the flow of gas/vapour and the direction of flow of the process liquid; and/or decrease the angle of a moveable flap (where present) in the apparatus if this angle is greater than a predetermined set point.

When the flow rate of the process liquid is too high, the control system may cause the pump speed to be decreased.

The control system may be provided with one or more sensors to detect shock at the mixing zone, i.e. whether the process liquid has been atomised by the gas/vapour. The sensors may be visual but will more usually be a pressure sensor as described above. There many also be one or more additional sensors to detect shock, i.e. the presence of atomised liquid, downstream of the mixing zone. This may be a similar sensor to the shock sensor at the mixing zone. The presence of atomised liquid downstream of the mixing zone may be an indication that excess energy is being introduced into the system.

Thus, when the mixing zone shock detector detects insufficient atomisation at the mixing zone or when the gas/vapour pressure falls below a predetermined value, the control system may cause the gas/vapour pressure to the nozzle to be increased.

When atomisation is detected downstream of the mixing zone; or the gas/vapour pressure to the nozzle exceeds the predetermined value, the control system may cause the pressure of gas/vapour supplied to the nozzle to be decreased.

The control system may also comprise an actuator for increasing the angle of any rotatable flaps, if this is less than a set value or decreasing the angle if the flow rate drops below a set value as described above.

When the apparatus has a rotatable nozzle and when the difference between upstream and downstream temperatures falls below the selected value, the control system may cause the nozzle to rotate such that the angle direction of the flow of gas/vapour and the direction of flow of the process liquid is increased; and when the difference between upstream and downstream temperatures is above the selected value or when the upstream temperature approaches a selected maximum value, the control system may may cause the nozzle to rotate such that the angle direction of the flow of gas/vapour and the direction of flow of the process liquid is decreased.

In a further aspect of the invention there is provided a process for mixing a material with a gas/vapour, the process comprising:

i. providing a process liquid comprising the material and a carrier liquid, wherein the process liquid is in the form of an aqueous suspension, colloidal solution or suspension or an emulsion;

ii. causing the process liquid to flow through a passage;

iii. contacting the process liquid with a gas/vapour, wherein the gas/vapour flows from a nozzle at supersonic velocity, such that the gas/vapour atomises the process liquid and mixes with the material;

characterised in that the passage is of polygonal cross section and the nozzle is configured as a slit running substantially perpendicular to the flow of process liquid such that the gas/vapour flows from the nozzle in a single plane.

The provision of gas/vapour at supersonic velocity can be achieved using a convergent divergent (de Laval) nozzle.

The nozzle may be configured such that the angle of impingement of the steam on the process liquid (i.e. the angle between the direction of the flow of steam and the direction of flow of the process liquid) is at least about 20°, more suitably at least 25° or at least 30°. For example the angle between the direction of the flow of steam and the direction of flow of the process liquid may be between about 20° and 90°.

The optimum angle of impingement for efficient mixing of the gas/vapour with the process liquid will vary according to the cross sectional profile of the passage; the particular properties of the process liquid, for example its flow rate, viscosity and temperature; and also the particular gas/vapour used and its pressure and temperature. However, for many process liquids, it has been found that improved mixing is obtained in the angle between the direction of the flow of steam and the direction of flow of the process liquid is between about 25° and 90°, more suitably between about 30° and 90°. This is particularly the case when the gas/vapour is steam.

When the gas/vapour is steam, in some cases, the nature of the process liquid is such that the angle between the direction of the flow of steam and the direction of flow of the process liquid is between about 35° and 80°, for example between about 35° and 60°, typically 40° to 50°.

Other features of this aspect are as for the first aspect of the invention.

The invention will now be described in greater detail with reference to the accompanying drawings in which.

Figure 6A:
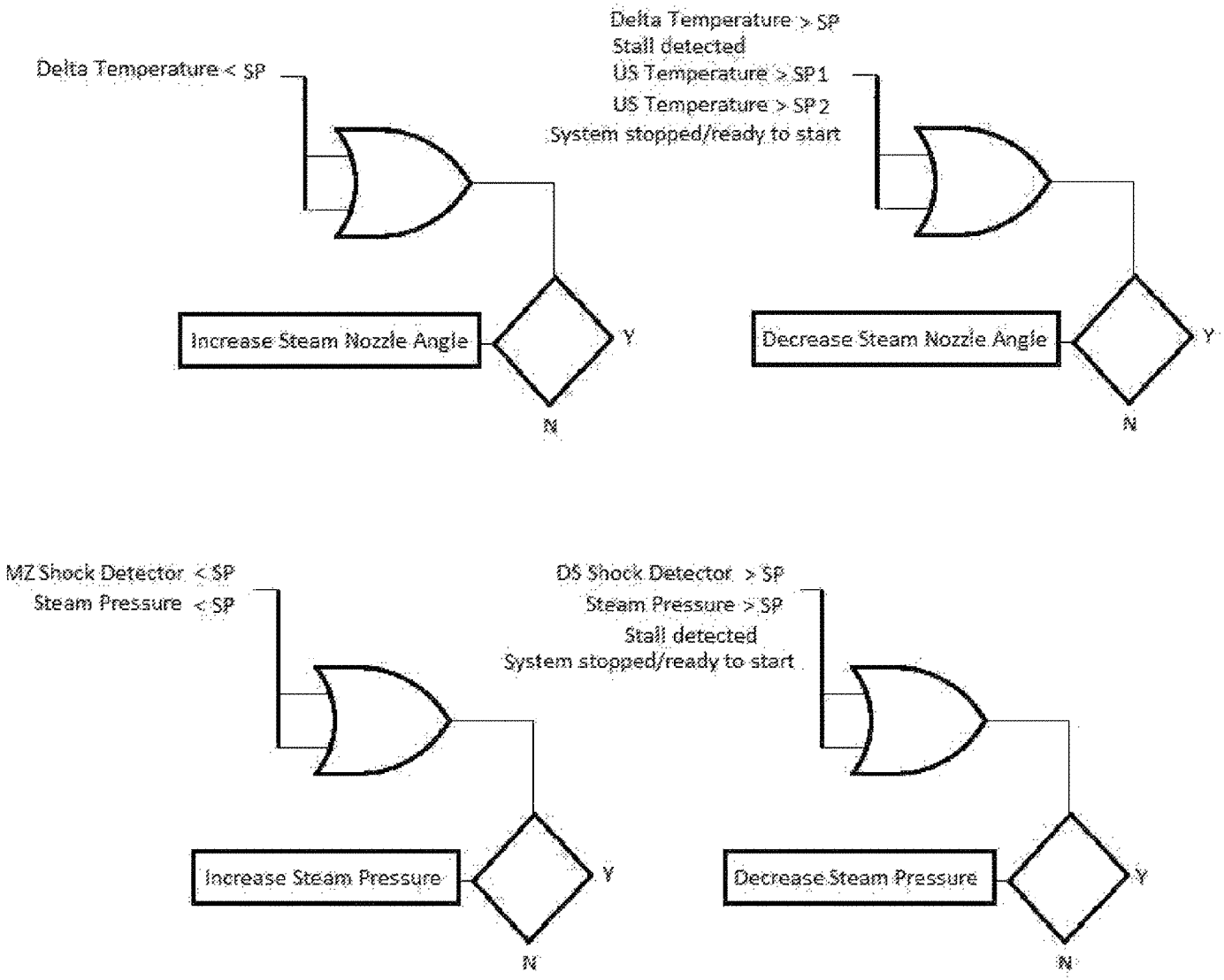
Figure 6B:
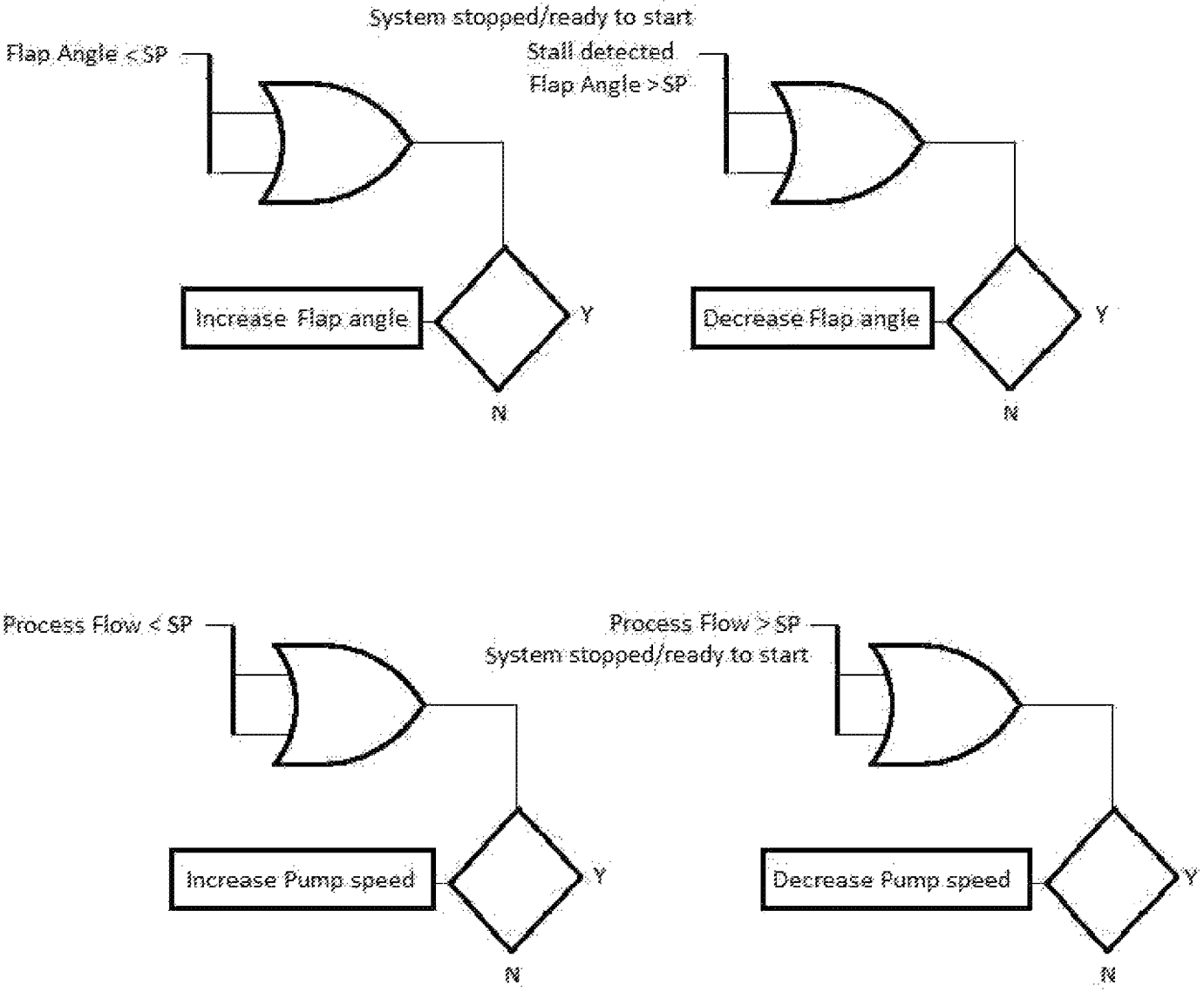

FIG. 6 is a schematic diagram of an example control system for a system comprising apparatus of the invention, in which US indicates upstream; DS indicates downstream; MZ indicates mixing zone; and SP indicates set point for a given variable (allowing for some deadband); and where the control loops may have proportional and/or integral and/or derivative function applied.

Figure 1:
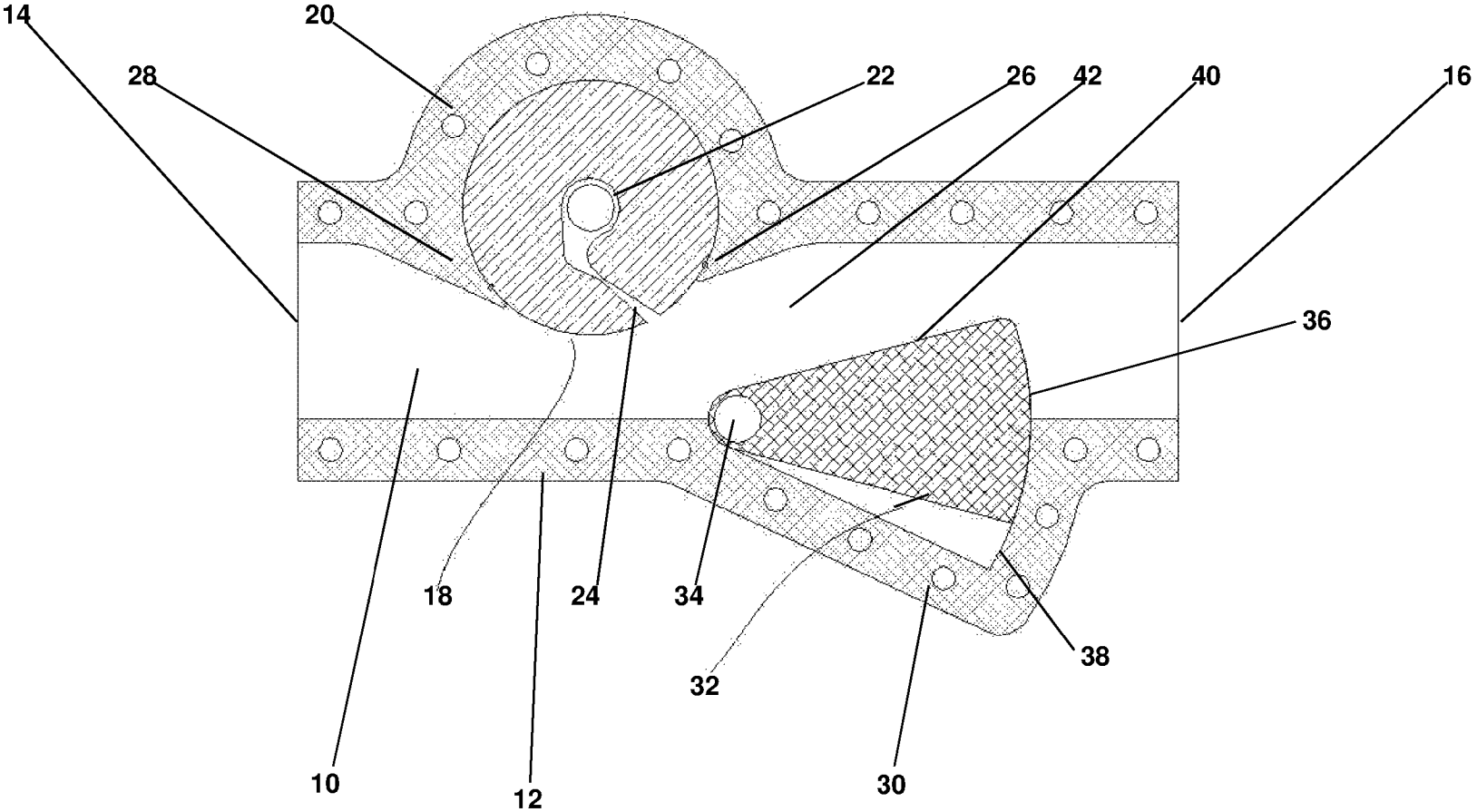
FIG. 1 is a cross sectional view of apparatus according to the invention.

FIG. 1 illustrates apparatus which comprises a passage (10) having substantially rectangular cross section and which is defined by a wall (12) formed from a metallic material such as stainless steel. The passage has an inlet (14) for a process liquid comprising a material to be mixed and hydrated and an outlet (16) for mixed hydrated material. The invention further comprises a cylinder (18) which is formed from a similar material to the wall (12) and which is housed in a housing (20) which forms a part of the wall (12) of the passage (10).

The cylinder (18) has defined therein a passage (22) to allow steam to flow from an steam inlet (not shown) to a steam nozzle (24) which opens from the lower part (26) of the cylinder into the passage (10). The steam nozzle (24) is in the form of a slit which runs parallel to the longitudinal axis of the cylinder (18).

The cylinder (18) is rotatable about its longitudinal axis so that the angle of the steam nozzle can vary with respect to the axis of the passage. At one extremity of the rotation, the nozzle (24) lies within the downstream end (26) of the housing (20) such that the nozzle is closed. At the other extremity of rotation, the nozzle (24) opens into the passage at a location adjacent the upstream end (28) of the housing (20).

Opposite and just downstream of the cylinder (18) the wall (12) of the passage (10) forms a housing (30) for a moveable flap (32). The flap (32) is in the form of a segment of a cylinder and is hinged at its edge (34) and has a face (36) which is rotatably in contact with a wall (38) of the housing. The flap can therefore rotate through an arc defined by its face (36) and by the wall (38) of the housing (30).

At one extremity of the rotation, the flap lies substantially within the housing (30) such that the greater part of the face (36) of the flap is in contact with the wall (38) of the housing and the flap (32) forms a large angle with the wall (12) of the passage. In this configuration the cross section of the passage (10) is slightly reduced in a region (42) which lies adjacent and immediately downstream of the cylinder (18), compared with the cross section of the passage upstream. This is the mixing zone where mixing of the process liquid with the steam and subsequent vaporisation of the process liquid takes place.

At the other extremity, the flap is rotated so that it protrudes into the passage, such that a flat upper surface (40) of the flap forms a reduced angle (i.e. less than 180°) with the wall (12), and such that the face (36) of the flap is only partially in contact with the wall (38) of the housing. In this configuration the cross section of the passage (10) is at the mixing zone (42) to a much greater extent than when the flap is at the other extremity of its movement.

Figure 2:
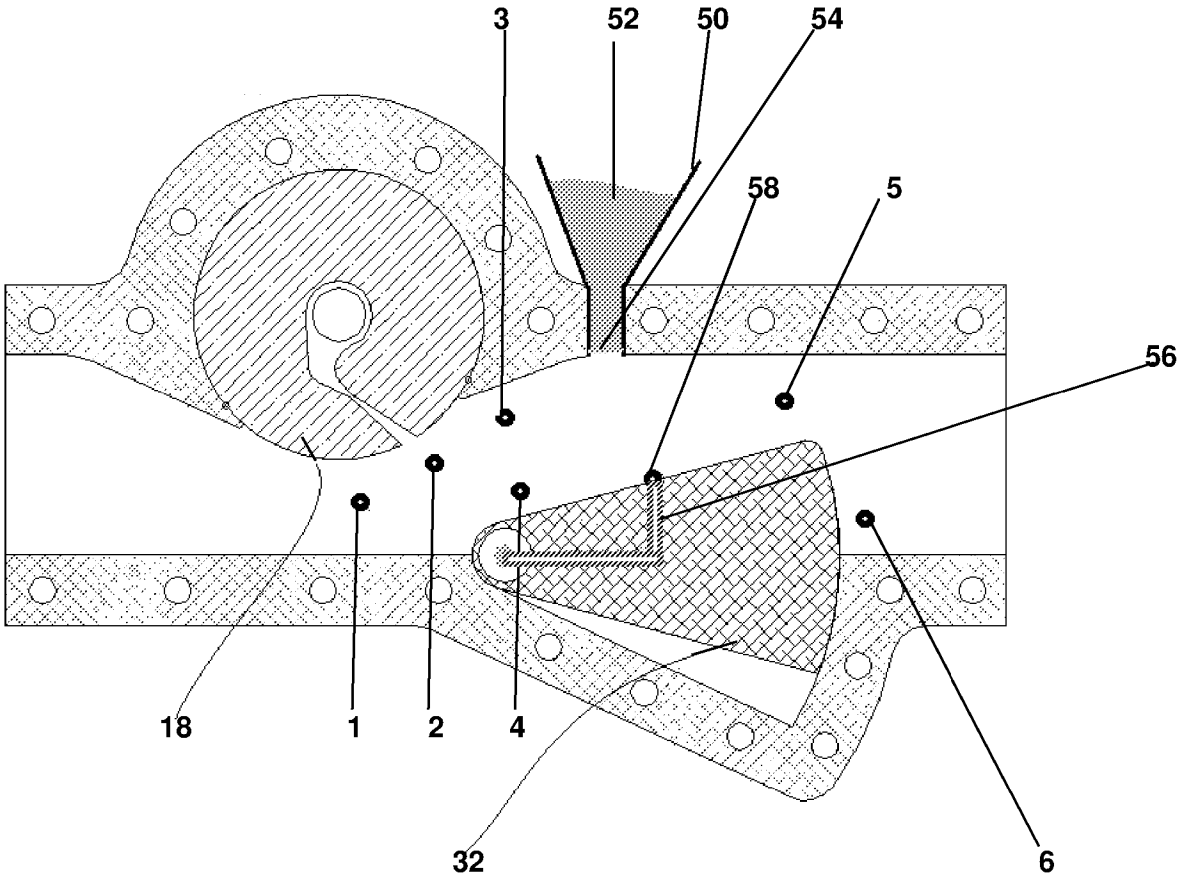
FIG. 2 is a similar view to FIG. 1 which shows apparatus with additional ports for the introduction of additional agents to the mixing zone and which shows the various regions of the passage where mixing takes place.

FIG. 2 shows a similar apparatus to FIG. 1 and illustrates how mixing takes place. FIG. 2 shows the pre-mixing zone (1) which is the region of the passage immediately upstream of the nozzle (24). In FIG. 2, zone (2) is the region inside the flow of steam issuing from nozzle (24) and zone (4) is the end point of the steam flow. Zone (3) is the low pressure side of the mixing zone and zone (5) is the re-condensation point, which effectively represents the end point of the mixing zone. In zone (6) there is a region of turbulence which assists with mixing.

The device of FIG. 2 has further features which are not present in the device of FIG. 1. The device has a powder entrainment hopper (50) positioned downstream of the cylinder (18) so that powder (52) can be added to the mixing zone via port (54).

In addition, the flap (32) is provided with an internal passage (56) such that a further agent, preferably a liquid can be added to the mixing zone via a port (58) which opens in the face (40) of the flap (32).

In use, a process liquid containing a material to be hydrated is pumped into the passage (10) via the inlet (14). Steam is supplied to the passage (22) of the cylinder (18) at a temperature and pressure such that choked flow is achieved at the narrowest point of the steam nozzle (24) ensuring that steam enters the passage (10) from the nozzle (24) at supersonic speed.

The steam from the nozzle (24) enters the passage (10) in the mixing zone (42) and strikes the process liquid causing heating and atomisation of the process liquid, which allows mixing with the steam and mixing/hydrating of the material.

If the mixing and/or hydrating is not optimal, however, the flap (32) may be moved into and out of the housing (30) until the optimum configuration is determined for the mixing zone (42) of the passage.

For further optimisation of the mixing and/or hydrating of the material, the cylinder (18) may be rotated such that the angle of impingement of the steam supplied from the steam nozzle (24) with the process liquid flowing from the inlet (14) is varied. The cylinder (18) may be rotated until the optimum angle of impingement of the steam on the process liquid has been determined.

This optimum angle may vary depending upon the material, the process liquid and their respective proportions as well as other considerations such as the exact temperature of the process liquid when it enters at inlet (14). Indeed, the optimum angle may vary for different batches of the same material.

Further ingredients may be added to the mixing zone via the hopper (50) and port (54) or via the passage (56) and port (58) formed in the flap.

Figure 3:
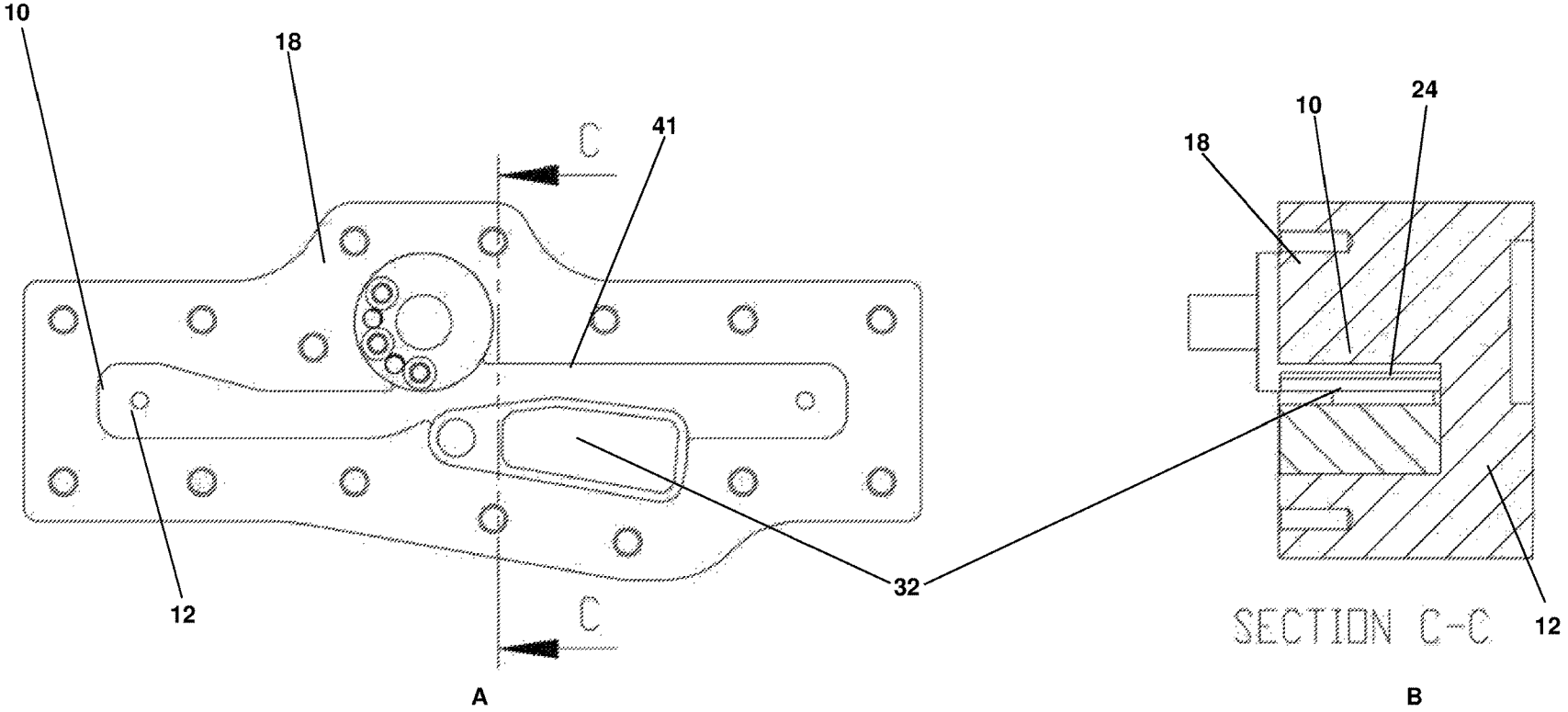
FIG. 3A shows a further device similar to that of FIG. 1.
FIG. 3B is a cross section through line C-C of FIG. 4A.
Figure 4:
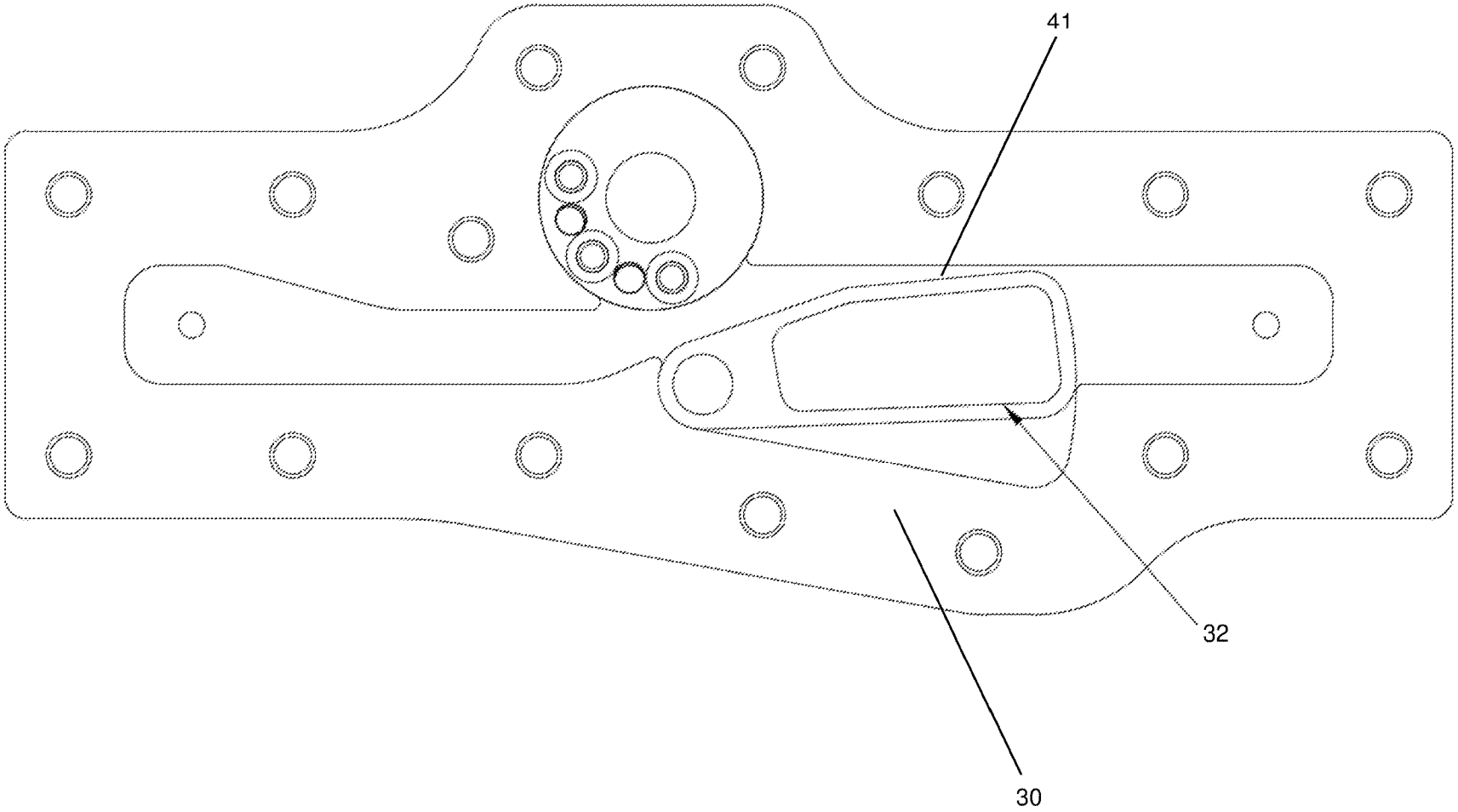
FIG. 4 shows the device of FIG. 4 in which the movable flap has been rotated through an angle of 12° in order to reduce the cross sectional area of the mixing zone.

FIG. 3A shows a further device similar to that of FIG. 1 and FIG. 3B is a cross section through line C-C of FIG. 4A. From FIG. 4B it can be seen that the passage (10) has rectangular cross section and that the nozzle (24) is in the form of a slit running parallel to the axis of the cylinder (18). FIG. 4B also shows how the cross sectional area of the passage (10) is reduced at the mixing zone through movement of the flap (32) within the housing (36). In the device of FIG. 4, the flap (32) has a contoured face (41) and has a smaller range of rotation than in the device of FIG. 1. The movement of the flap is shown in FIG. 4, in which the flap (32) has been rotated through an angle of 12° so as to reduce the cross sectional area of the mixing zone with respect to the flap position of 0° shown in FIG. 4.

Figure 5:
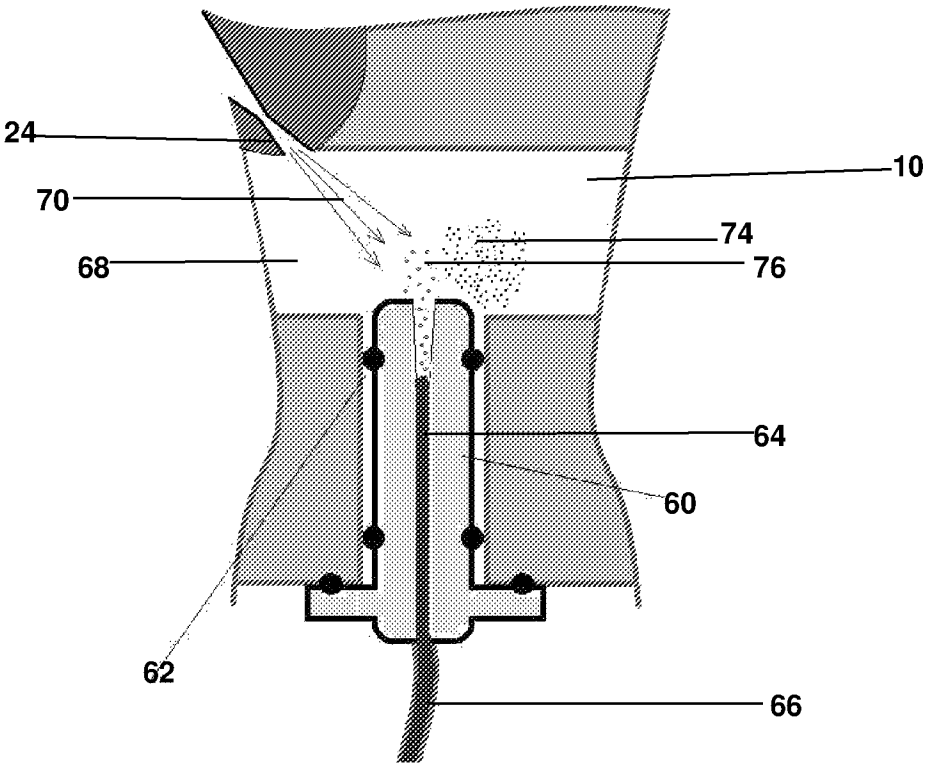
FIG. 5 is a cross section of a detail of the mixing zone of an alternative embodiment in which an additional liquid is introduced via an ultrasonic droplet generating injection device.

FIG. 5 shows a detail of the mixing zone (42) of the passage (10) in an alternative embodiment which includes an ultrasonic droplet generating injection device (60). The ultrasonic injection device (60) is mounted in the wall of the passage (10) opposite the nozzle (24). The ultrasonic injection device (60) is mounted on seals (62), for example O-rings, which prevent the process liquid (68) from leaking from the passage (10) but which allow movement, especially vibration, of the ultrasonic injection device (60).

A stream of liquid (66) enters the ultrasonic injection device and is split by ultrasonic resonance into droplets (76), such that the liquid (66) is pre-conditioned before it is contacted by the steam, which flows from the nozzle (24) as indicated by arrows (70).

Contact of the droplets (76) with the steam produces atomised liquid (74). The process liquid (68) is also atomised by the steam and can therefore easily mix with the atomised liquid (74) to form a mixture.

The liquid (66) may be an active agent which is designed to combine with the material in the process liquid (68). Alternatively, however, it may be a liquid, for example an oil, which is intended to form an emulsion, a double emulsion, a microemulsion or similar composition with the atomised process liquid.

In an alternative embodiment, the ultrasonic injection device (60) may be mounted in a flap (32) of a device similar to that shown in FIG. 2.

FIG. 6 shows an example of a control system for a system comprising apparatus of the present invention. The system comprises a reservoir for the process liquid which is in fluid connection with a device of FIG. 1, FIG. 2 or FIGS. 3 and 4. Downstream of the device is a collection vessel for mixed and hydrated process liquid.

The process liquid is moved from the reservoir, through the device and into the collection vessel by a pump. The device is equipped with a number of sensors; including sensors for detecting the temperature of process liquid upstream and downstream of the mixing zone; a sensor for detecting the flow rate of the process liquid immediately downstream of the mixing zone; and shock sensors for detecting atomisation at the mixing zone and downstream of the mixing zone.

The device also comprises an actuator for rotating the cylinder (18) such that the angle of impingement of the steam supplied from the steam nozzle (24) with the process liquid flowing from the inlet (14) is varied.

The device further comprises an actuator for moving the flap (32) into and out of the housing (30).

There are also means for adjusting the steam pressure and the speed of the pump.

In use, the operator selects a suitable inlet temperature and an appropriate temperature difference across the device. The upstream temperature sensor detects the inlet temperature and downstream temperatures sensor detects the outlet temperature. As shown in FIG. 6, if the difference between the inlet and outlet temperatures falls below the selected appropriate temperature difference, the control system causes the actuator to rotate the cylinder (18) such that the angle between the flow of steam and the flow of process liquid is increased. On the other hand, if the temperature difference rises above the selected value or if the inlet temperature (US temperature) is approaching a selected maximum value, the control system causes the actuator to rotate the cylinder (18) such that the angle between the flow of steam and the flow of process liquid is decreased.

The operator sets a required value for the flow rate through the apparatus. FIG. 6 shows that if the flow rate falls below the required value or if a stall in the flow is detected; or if the apparatus is stopped and is ready to start, the control system may:

cause the actuator to rotate the cylinder (18) such that the angle between the flow of steam and the flow of process liquid is decreased; and/or decrease the angle of any flaps; and/or decrease the steam pressure; and/or increase the pump speed.

It is important for efficient mixing that the process liquid is fully atomised in the mixing zone. Therefore, as shown in FIG. 6, if the shock sensor at the mixing zone (suitably a piezoelectric element) detects incomplete atomisation at the mixing zone, the control system causes the pressure of the steam supplied to the nozzle to be increased.

On the other hand, it is not optimal for the process liquid to be atomised downstream of the mixing zone since this is a waste of energy. Therefore if the shock sensor downstream of the mixing zone detects atomisation, the control system causes the pressure of the steam supplied to the nozzle to be decreased.

The present invention therefore provides apparatus which allows mixing and/or hydrating of a material mixed with a process liquid using steam. The apparatus comprises means for adjusting and optimising the configuration of the mixing zone where mixing and/or hydrating take place. In addition, the nozzle via which steam is introduced may be adjustable such that the angle of impingement of the steam on the process liquid can be varied in order to determine the optimum conditions.

The invention claimed is:

1. Apparatus for mixing a material with a gas/vapour, the apparatus comprising:

a passage defined by a wall and having an inlet and an outlet, wherein a process liquid comprising a material and a carrier liquid flows from said inlet to said outlet; and a nozzle for introducing a gas/vapour into said passage at a mixing zone, wherein the cross sectional profile of the passage at the mixing zone is polygonal and said nozzle is configured as a slit, wherein said slit runs in a direction substantially perpendicular to the direction of flow of said process liquid at said inlet such that said gas/vapour enters said passage in a single plane and wherein the cross sectional area of said passage at said mixing zone is smaller than the cross sectional area of said passage at said inlet and wherein said nozzle is positioned in said wall of said passage above said process liquid such that said gas/vapour flows downwards towards said process liquid;

wherein said process liquid comprises a suspension of a solid in a liquid, a colloidal solution or suspension, or an emulsion;

characterised in that:

said nozzle is provided in a rotatable member, wherein said rotatable member is rotatable through an arc of at least 10° such that the angle between said direction of flow of said gas/vapour and said direction of flow of said process liquid can be varied; and said nozzle has a nozzle profile comprising a de Laval convergent-divergent section extending along the slit for introducing said gas/vapour at supersonic velocity into said passage at said mixing zone.

2. Apparatus as claimed in claim 1, wherein said material is selected from the group consisting of: (i) a polysaccharide selected from starch; (ii) natural gums such as agar, alginic acid, sodium alginate, carrageenan, gum Arabic, gum tragacanth, guar gum, locust bean gum, beta-glucan and xanthan gum; (iii) cellulose and carboxymethylcellulose; and (iv) a protein or a fat.

3. Apparatus as claimed in claim 1, wherein said material comprises a foodstuff.

4. Apparatus as claimed in claim 1, wherein said gas/vapour comprises steam.

5. Apparatus as claimed in claim 1, wherein said passage at said mixing zone is rectangular in cross section.

6. Apparatus as claimed in claim 1, wherein the angle between the direction of flow of said gas/vapour and said direction of flow of said process liquid is at least 10°.

7. Apparatus as claimed in claim 1, wherein said rotatable member rotates through at least 20°.

8. Apparatus as claimed in claim 1, wherein said wall of said passage forms a housing for said rotatable member.

9. Apparatus as claimed in claim 8, wherein the rotatable member can be rotated into a position in which the nozzle abuts the wall of the passage such that the outlet of the nozzle is closed off from the passage, preventing or substantially limiting the flow of gas/vapour.

10. Apparatus according to claim 1, further comprising one or more movable flaps mounted on said wall of the passage at said mixing zone.

11. Apparatus as claimed in claim 10, wherein said one or more movable flaps comprise a flap which is hinged at its upstream end and is rotatable through an arc of up to 60° between a first position and a second position in which it forms a lesser angle with the wall of the passage.

12. Apparatus as claimed in claim 1, wherein said carrier liquid comprises water or an aqueous solution containing one or more solutes.

13. A system for mixing a material with a gas/vapour, the system comprising:

a reservoir for a process liquid comprising a material and a carrier liquid;

apparatus according to claim 1, wherein said apparatus is in fluid connection with said reservoir;

a collection vessel for mixed and/or hydrated material in fluid connection with said apparatus;

a pump for pumping said process liquid from said reservoir through said apparatus and into said collection vessel;

a source of gas/vapour in fluid connection with said nozzle; and a control system for controlling the pressure and/or temperature of said gas/vapour.

14. A system as claimed in claim 13, wherein said control system is further arranged and adapted to control one or more of: (i) a heating element for raising the temperature of said process liquid upstream of said mixing zone; (ii) a pump for pumping said process liquid through said apparatus; (iii) said rotatable member in order to vary the angle between said direction of flow of said gas/vapour and said direction of flow of said process liquid; and (iv) the positions of one or more movable flaps.

15. A process for mixing a material with a gas/vapour, the process comprising:

providing a passage defined by a wall and having an inlet and an outlet and causing a process liquid comprising a material and a carrier liquid to flow from said inlet to said outlet; and introducing a gas/vapour into said passage at a mixing zone via a nozzle, wherein the cross sectional profile of the passage at the mixing zone is polygonal and wherein said nozzle is configured as a slit, wherein said slit runs in a direction substantially perpendicular to the direction of flow of said process liquid at said inlet such that said gas/vapour enters said passage in a single plane and wherein the cross sectional area of said passage at said mixing zone is smaller than the cross sectional area of said passage at said inlet and wherein said nozzle is positioned in said wall of said passage above said process liquid such that said gas/vapour flows downwards towards said process liquid;

wherein said process liquid comprises a suspension of a solid in a liquid, a colloidal solution or suspension, or an emulsion;

characterised in that:

said nozzle is provided in a rotatable member wherein said rotatable member is rotatable through an arc of at least 10° such that the angle between the direction of said flow of said gas/vapour and said direction of flow of said process liquid can be varied; and said process further comprises introducing said gas/vapour at supersonic velocity into said passage at said mixing zone via said nozzle having a nozzle profile comprising a de Laval convergent-divergent section that extends along the slit.

16. A process as claimed in claim 15, wherein said material is selected from the group consisting of: (i) a polysaccharide selected from starch; (ii) natural gums such as agar, alginic acid, sodium alginate, carrageenan, gum Arabic, gum tragacanth, guar gum, locust bean gum, beta-glucan and xanthan gum; (iii) cellulose and carboxymethylcellulose; and (iv) a protein or a fat.

17. Apparatus for mixing a material with a gas/vapour, the apparatus comprising:

a passage defined by a wall and having an inlet and an outlet, wherein a process liquid comprising a material and a carrier liquid flows from said inlet to said outlet; and a nozzle for introducing a gas/vapour into said passage at a mixing zone, wherein the cross sectional profile of the passage at the mixing zone is polygonal and said nozzle is configured as a slit, wherein said slit runs in a direction substantially perpendicular to the direction of flow of said process liquid at said inlet such that said gas/vapour enters said passage in a single plane and wherein the cross sectional area of said passage at said mixing zone is smaller than the cross sectional area of said passage at said inlet and wherein said nozzle is positioned in said wall of said passage above said process liquid such that said gas/vapour flows downwards towards said process liquid;

wherein said process liquid comprises a suspension of a solid in a liquid, a colloidal solution or suspension, or an emulsion;

characterised in that:

said nozzle is provided in a rotatable member, wherein said rotatable member is rotatable through an arc of at least 10° such that the angle between said direction of flow of said gas/vapour and said direction of flow of said process liquid can be varied; and said nozzle has a nozzle profile comprising a de Laval convergent-divergent section for introducing said gas/vapour at supersonic velocity into said passage at said mixing zone and further comprising a flap positioned fully downstream of the nozzle.

* * * * *